US008869984B2

(12) United States Patent
Bellamah

(10) Patent No.: US 8,869,984 B2
(45) Date of Patent: Oct. 28, 2014

(54) BOXED BLISTER PACK HAVING SLIDE AND RETAIN FEATURE

(75) Inventor: Stephen J. Bellamah, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 93 days.

(21) Appl. No.: 12/710,950

(22) Filed: Feb. 23, 2010

(65) Prior Publication Data

US 2011/0011756 A1 Jan. 20, 2011

Related U.S. Application Data

(60) Provisional application No. 61/154,456, filed on Feb. 23, 2009.

(51) Int. Cl.
*B65D 83/04* (2006.01)
*B65D 5/38* (2006.01)

(52) U.S. Cl.
CPC ..... *B65D 83/0463* (2013.01); *B65D 5/38* (2013.01)
USPC ..... 206/468; 206/531; 206/538

(58) Field of Classification Search
USPC ..... 206/1.5, 528–540; 229/125.125, 125.12
See application file for complete search history.

(56) References Cited

U.S. PATENT DOCUMENTS 3,820,655 A * 6/1974 La Tourette et al. ..... 206/532
4,279,373 A * 7/1981 Montealegre ..... 206/0.5
6,032,795 A * 3/2000 Ehrlund et al. ..... 206/312
6,047,829 A * 4/2000 Johnstone et al. ..... 206/531
6,491,211 B1 * 12/2002 Evans et al. ..... 206/532
6,752,272 B2 * 6/2004 Jones et al. ..... 206/534
2004/0026293 A1 2/2004 Hughes
2004/0188315 A1 9/2004 Morita et al.
2007/0054525 A1 * 3/2007 Jones et al. ..... 439/159
2009/0293889 A1 12/2009 Kumar et al.
2011/0163156 A1 * 7/2011 Smith et al. ..... 229/125.125

FOREIGN PATENT DOCUMENTS

WO 0238454 A1 5/2002
WO 2007/030563 A1 3/2007
WO WO 2008073117 A2 * 6/2008

* cited by examiner

*Primary Examiner* — Mickey Yu
*Assistant Examiner* — Chun Cheung
(74) *Attorney, Agent, or Firm* — Roberts Mlotkowski Safran & Cole, P.C.

(57) ABSTRACT

A packaging structure for receiving at least one blister pack. The packaging structure includes at least one blister pack retainer for receiving and enclosing the blister pack, the blister pack retainer having a first side member, a second side member, a first end and a second end, the second end having at least one tab portion extending therefrom, and a slidable cover for enclosing the at least one blister pack retainer, the cover having a first end and a second end, the first end having at least one tab stop member extending therefrom, whereby when the at least one blister pack retainer is withdrawn from the slidable cover, the at least one tab stop member of the slidable cover and the at least one tab portion of the at least one blister pack retainer cooperate to restrain the at least one blister pack retainer from being fully withdrawn from the slidable cover. A method of making a packaging structure is also provided.

10 Claims, 8 Drawing Sheets

BOXED BLISTER PACK HAVING SLIDE AND RETAIN FEATURE

RELATED APPLICATION

This patent application claims the benefit of Provisional Application Ser. No. 61/154,456, filed on Feb. 23, 2009, directed to packaging for use with blister packs and, more particularly, to packaging for use with blister packs that contain a plurality of tablets, such as smokeless compressed tobacco products, which is hereby incorporated by reference in its entirety.

FIELD

This document relates generally to packaging for use with blister packs and, more particularly, to packaging for use with blister packs that contain a plurality of tablets, such as smokeless compressed tobacco products.

WORKING ENVIRONMENT

Recently, new forms of smokeless tobacco products have entered the market place or have been described, including products in the form of gels, films and tablets. Designing packaging for use with a smokeless tobacco product in the form of a tablet provides unique challenges. For example, with tobacco-based products, moisture content can become an issue, since tobacco is, by its nature, hygroscopic. Child-resistance is also another desirable property for packaging used with a smokeless tobacco product.

In the packaging of tablets for distribution to consumers, blister packs are frequently utilized. In particular, when dispensing pharmaceutical or certain other consumer products, blister packaging is generally favored over loose or bottled tablets, for certainty in quantity dispensed, security of storage and convenience of use.

Blister packs are commonly formed by molding a thin sheet of synthetic plastic or laminate material into a multi-pocket or compartment tray-like structure. This may be undertaken continually on-line followed by a filling and closure operation.

The pockets or compartments are commonly disposed in a rectangular grid array. Typically, an individual pocket is intended to contain a single item. Pocket contents may be accessed at random, or, in certain instances, in a prescribed sequence. A peripheral upstanding rim, ledge or ridge may be incorporated, to help stiffen the overall tray profile and further protect the contents of the compartments.

Blister packs are typically formed by molding resiliently deformable synthetic plastics, such as polyvinyl chloride (PVC) or aluminum laminates, such as polyamide/aluminum/PVC, with a pre-configured array of multiple discrete pockets or blisters.

A tablet is captured or restrained within the pockets by a releasable, removable or frangible backing layer, typically produced from a metal, such as aluminum foil, metalized plastics foil, or a laminated paper and foil combination. In a laminated paper and foil combination, the paper is adhesively bonded in a laminated, multi-ply, overlay to the foil, and used as a lift-off release layer. As such, the paper is intended to protect the underlying foil while the paper is in place. To that end, the paper is bonded to the foil, and is not otherwise secured to the blister pack itself.

As may be appreciated, given their construction, blister packs, and the intentionally frangible backing foil layer are vulnerable to inadvertent impact or abrasion contact damage and consequent unintentional pack rupture and attendant product fracture, fragmentation, or displacement and loss. Thus folding, creasing or crushing, such as may arise by carrying a foil-backed blister in the pocket, can lead to content contamination, displacement and loss altogether. Similarly, casual handling by an inquisitive child can enable accidental content access and the risk of consumption.

To address these issues, blister packs are sometimes combined with another packaging element, such as a wallet, envelope, pocket, pouch, wrap or shroud. The other packaging element may also provide space for the addition of information and user instructions to meet regulatory requirements or the like. Such an additional packaging element may prove convenient for personal storage in garment pockets, handbags, purses or wallets.

U.S. Patent Publication No. 2004/0026293 proposes a blister pack folded wallet that has a mounting card a hinged spine segment, and an adhesive edge strip. Child resistance is said to be available through cover latching and/or paper reinforced foil laminate, with through apertures and perforations for selective localized paper patch removal over individual blister pockets.

U.S. Patent Publication No. 2004/0188315 proposes a press-through packaging case that includes a case body having first and second sheet members that are overlapped to each other so as to place a press-through package therebetween. The press-through packaging has at least one blister each containing one or more pills. The first sheet member has at least one elongated hole, through which the at least one blister protrudes to the outside, so that the at least one blister is pressed along the at least one elongated hole. The second sheet member proposed has at least one take-out portion located facing to the at least one elongated hole at such a position as to be matched in position to the at least one blister of the press-through package when the press-through package has been slid to a predetermined point.

U.S. Patent Publication No. 2004/0026293 proposes a blister pack case that includes a first case half and a second case half. The halves are hinged on one another. The first case half has a pocket for receiving the blister pack and has an outer part and an inner viewing part and also first apertures in the viewing part and second apertures in the outer part. The second case half has a first compartment for receiving a first display means displaying days of the week, and first windows for displaying the days of the week in an inner viewing surface of the second case half in the area of the first compartment.

Despite these advances in the art, there remains a need for improved packaging structures for use with blister packs that contain a plurality of tablets, such as smokeless compressed tobacco products and for methods for making such packaging.

SUMMARY

Disclosed herein are packaging structures for use with blister packs that contain a plurality of tablets and for methods for making such packaging.

In one aspect, provided is a packaging structure for receiving at least one blister pack. The packaging structure includes at least one blister pack retainer for receiving and enclosing the blister pack, the blister pack retainer having a first side member, a second side member, a first end and a second end, the second end having at least one tab portion extending therefrom, and a slidable cover for enclosing the at least one blister pack retainer, the cover having a first end and a second end, the first end having at least one tab stop member extending therefrom, whereby when the at least one blister pack retainer is withdrawn from the slidable cover, the at least one tab stop member of the slidable cover and the at least one tab portion of the at least one blister pack retainer cooperate to restrain the at least one blister pack retainer from being fully withdrawn from the slidable cover.

In one form, the first side member of the at least one blister pack retainer has a plurality of first apertures and the second side member of the at least one blister pack retainer has a plurality of second apertures, the first apertures being at least partially aligned with the second apertures.

In another form, the at least one blister pack includes a plurality of receptacles, the plurality of receptacles positioned within the plurality of first apertures of the first side member and/or the plurality of second apertures of the second side member.

In yet another form, the plurality of receptacles of the at least one blister pack are arranged in at least two columns.

In still yet another form, the first and/or second apertures are oblong in shape.

In a further form, the packaging structure includes a second blister pack retainer for receiving a second blister pack, the second blister pack retainer having a first side member, a second side member, a first end and a second end, said second end having at least one tab portion extending therefrom.

In a yet further form, at least one surface of the slidable cover for enclosing the at least one blister pack retainer includes a printable region for displaying informational material.

In another aspect, provided is a method of forming a packaging structure from a sheet of stock. The method includes the steps of cutting the sheet of stock into a size and shape sufficient to form at least a first and a second substrate having a plurality of panels, folding the first substrate to form a blister pack retainer for receiving a blister pack, the blister pack retainer having a first side member, a second side member, a first end and a second end, said second end having at least one tab portion extending therefrom, and folding the second substrate to form a slidable cover for enclosing the blister pack retainer, the slidable cover having a first end and a second end, said first end having at least one tab stop member extending therefrom, whereby when the blister pack retainer is withdrawn from the slidable cover, the at least one tab stop member of the slidable cover and the at least one tab portion of the blister pack retainer cooperate to restrain the at least one blister pack retainer from being fully withdrawn from the slidable cover.

In one form, the method includes the step of folding a third substrate to form a second blister pack retainer for receiving a second blister pack.

In another form, the blister pack is adhesively secured to inner surfaces of the at least one inner blister pack retainer.

These and other features will be apparent from the detailed description taken with reference to the accompanying drawings.

BRIEF DESCRIPTION OF THE DRAWINGS

Further explanation may be achieved by reference to the description that follows and the drawings illustrating, by way of non-limiting examples, various forms, wherein.

DETAILED DESCRIPTION

Figure 1:
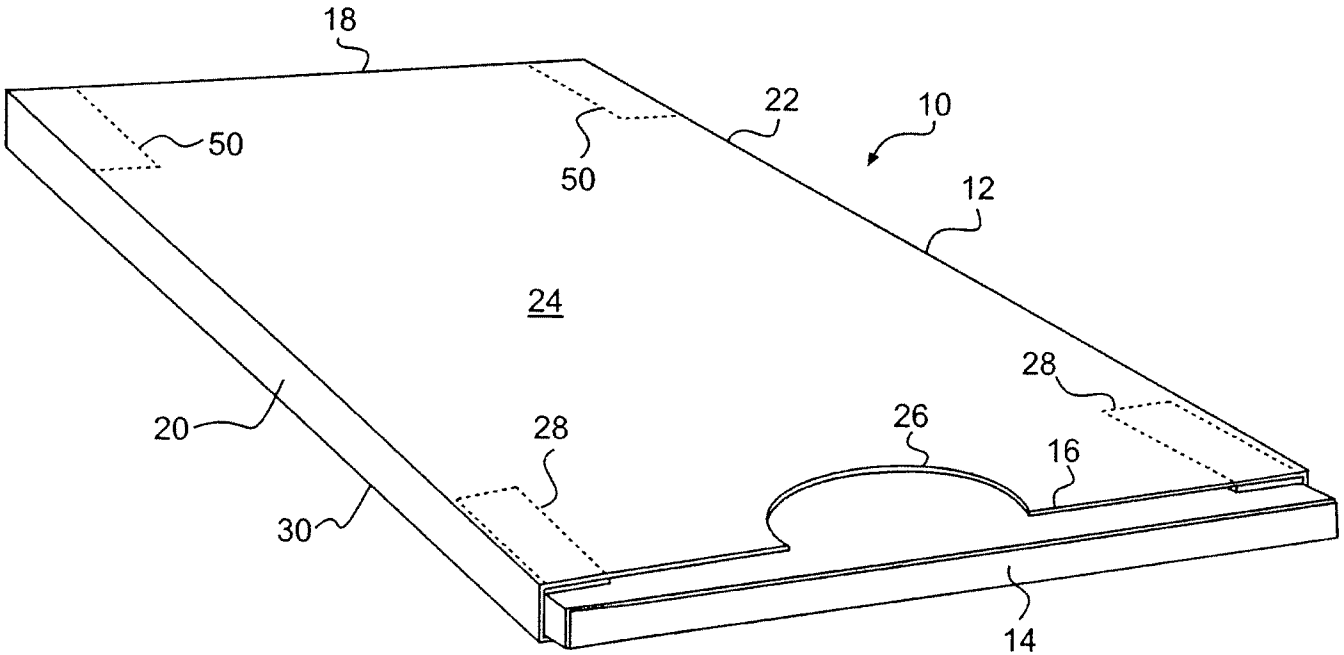
FIG. 1 is a perspective view of a packaging structure, in accordance herewith.
Figure 2:
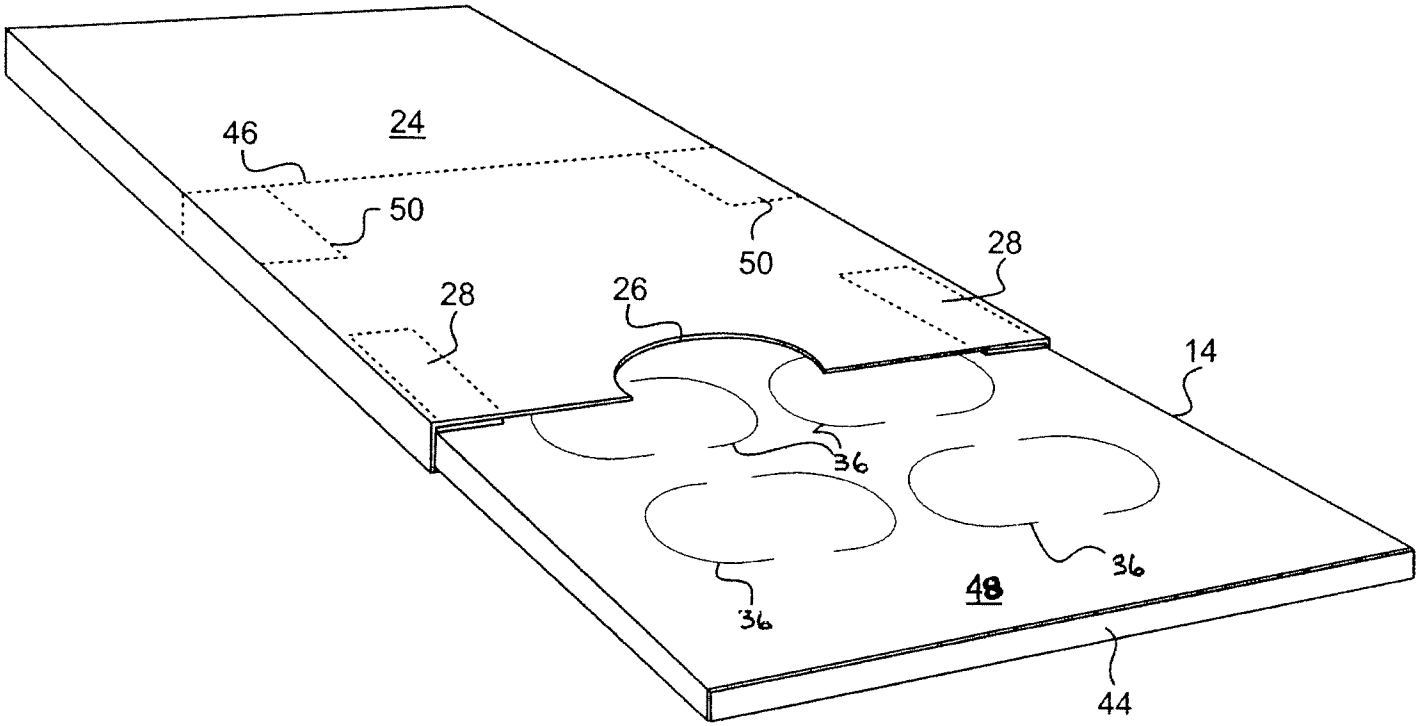
FIG. 2 is a perspective view of a packaging structure, showing a partially withdrawn blister pack retainer, in accordance herewith.

Various aspects will now be described with reference to specific forms selected for purposes of illustration. It will be appreciated that the spirit and scope of the packages and methods disclosed herein are not limited to the selected forms. Moreover, it is to be noted that the figures provided herein are not drawn to any particular proportion or scale, and that many variations can be made to the illustrated forms. Reference is now made to FIGS. 1-8, wherein like numerals are used to designate like elements throughout.

Definitions

The term "blister pack" is used herein to embrace a preformed or pre-configured packaging sheet or layer, for example configured as a shallow tray, pre-profiled with multiple localized compartments or pockets. The individual compartment profile conveniently complements that of the intended contents, to ensure a snug relative fit. The pocket wall affords some resistance to impact, but is typically deformable to allow contents displacement and ejection, and modest cushioning action.

The term "child-resistant" relates to certain measures to impede unauthorized pack opening or access to children, as might otherwise arise by casual or curious handling, as encountered in child play. Such provision represents a precautionary or deterrent measure, rather than necessarily an absolute defense/

The term "tablet" is used in its common context, and refers to a solid composition made by compressing and/or molding a mixture of compositions in a form convenient for buccal application.

Referring to FIGS. 1-4, one form of a packaging structure 10 for receiving at least one blister pack 100 (see FIG. 3), in accordance herewith, is shown. Packaging structure 10 includes at least one blister pack retainer 14 for receiving and enclosing blister pack 100 (see FIGS. 3 and 4).

Blister pack retainer 14 has a first side member 40 and a second side member 48, a first end 44 and a second end 46. As may be seen, the second end 46 has at least one tab portion 50 extending from second end 46 and folded back onto first side member 40. In one form, two tab portions 50 extend from second end 46 and are folded back onto first side member 40.

Referring still to FIGS. 1-4, a slidable cover 12 is provided for enclosing the at least one blister pack retainer 14. Slidable cover 12 has a first end 16 and a second end 18, first end 16 having at least one tab stop member 28 extending therefrom. As may be seen from FIGS. 3 and 4, when the at least one blister pack retainer 14 is withdrawn from the slidable cover 12, the at least one tab stop member 28 of the slidable cover and the at least one tab portion 50 of the at least one blister pack retainer 14 cooperate to restrain the at least one blister pack retainer 14 from being fully withdrawn from the slidable cover 12.

Figure 6A:
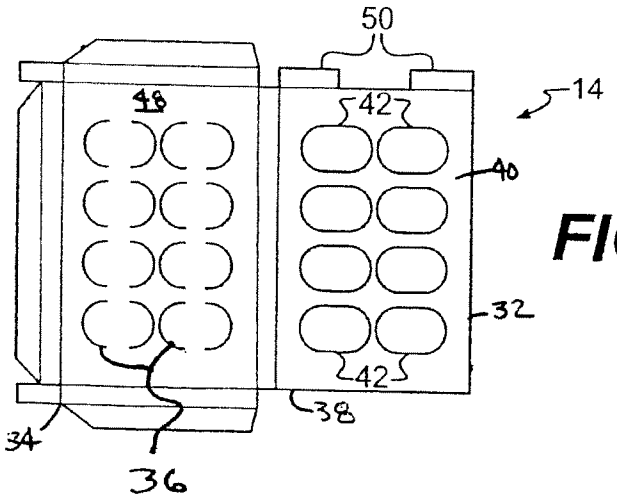
FIG. 6 depicts a lay flat view of a substrate for use in forming a blister pack retainer of a packaging structure, in accordance herewith.
Figure 6B:
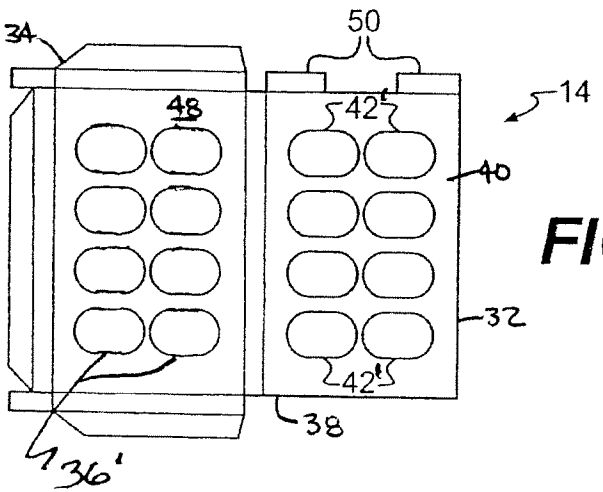

As shown in FIGS. 6A and 6B, the first side member 40 of the at least one blister pack retainer 14 of the packaging structure 10 is provided with a plurality of first apertures 42 or 42'. The opposing second side member 48 (see FIGS. 6A and 6B) of the at least one blister pack retainer 14 of packaging structure 10 may also be provided with a plurality of second apertures 36 or 36'. As may be seen from FIGS. 6A and 6B, in one form, the first apertures 42 or 42' are at least partially aligned with the second apertures 36 or 36'.

Figure 3:
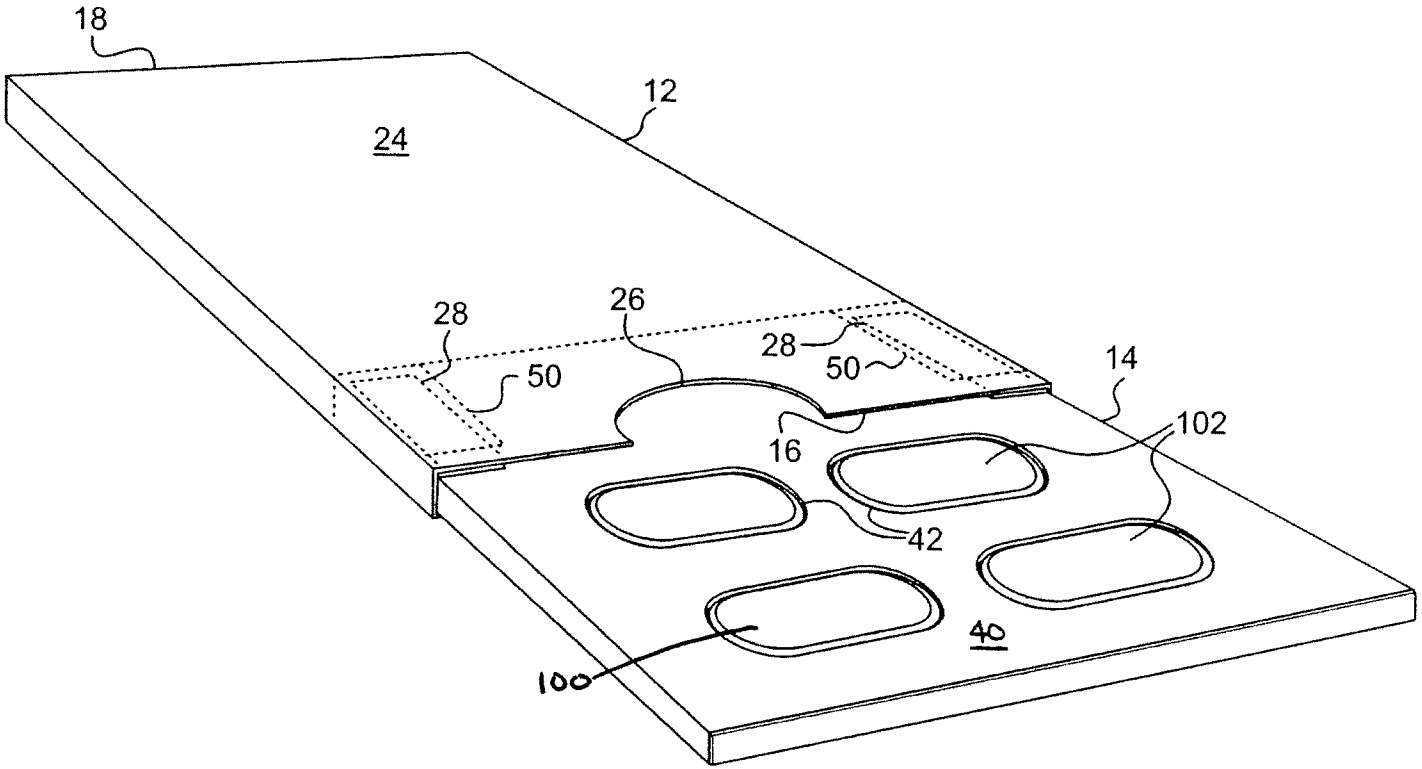
FIG. 3 is a partial perspective view of a packaging structure showing a partially withdrawn blister pack retainer having a blister pack inserted within the blister pack retainer.
Figure 4:
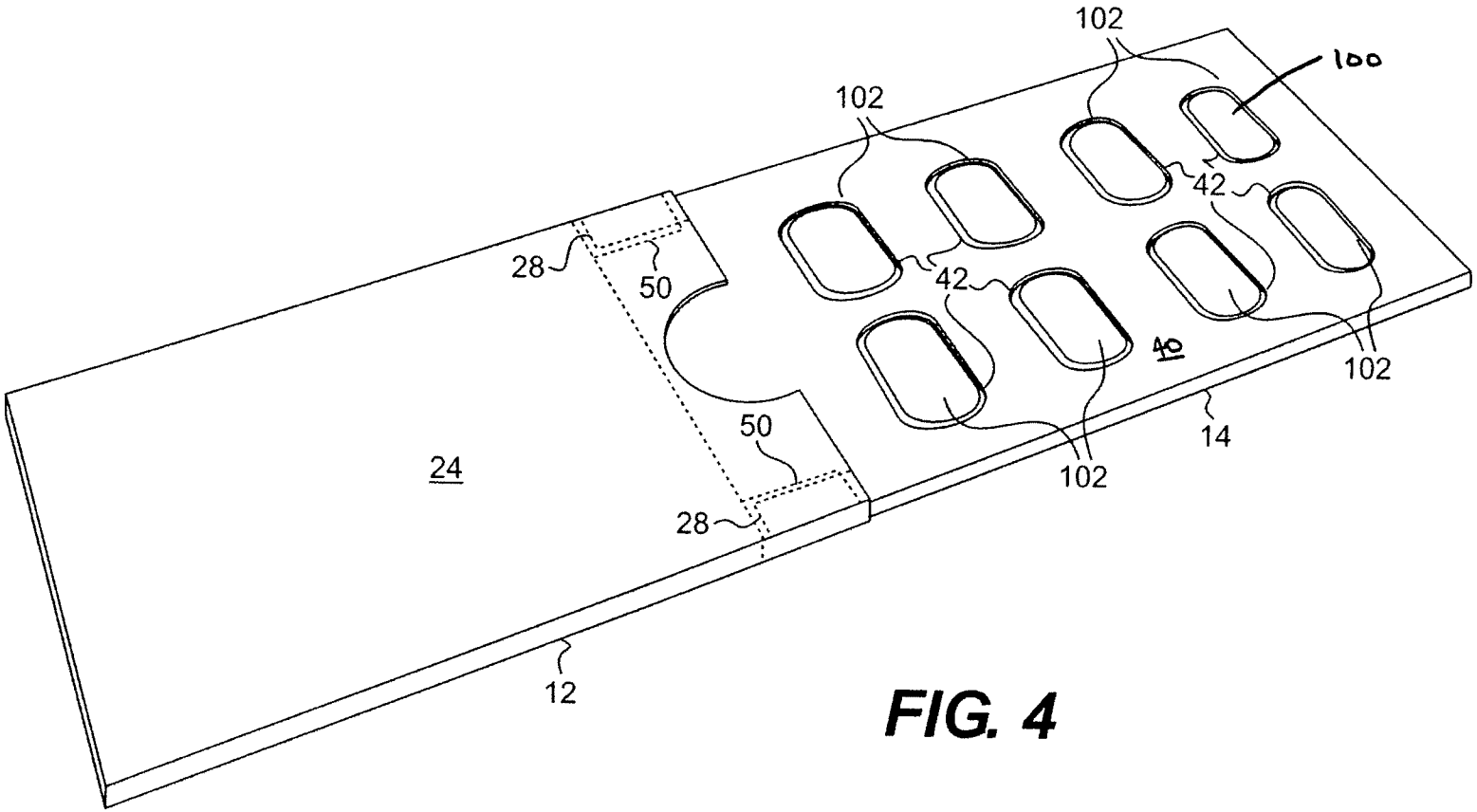
FIG. 4 is a perspective view of a packaging structure showing a fully withdrawn blister pack retainer having a blister pack inserted within the blister pack retainer.

Referring now to FIGS. 3 and 4, in one form, packaging structure 10 includes at least one blister pack 100. Blister pack 100 includes a plurality of receptacles 102. Referring to FIG. 3, each receptacle 102 containing a tablet (not shown). In one form, when installed within the at least one inner blister pack retainer 14 the plurality of receptacles 102 are positioned within the plurality of first apertures 42 of first side member 40 of the at least one inner blister pack retainer 14 and/or the plurality of second apertures 36 of second side member 48 of at least one inner blister pack retainer 14 of packaging structure 10.

In one form, the plurality of receptacles 102 of the at least one blister pack 100 are arranged in at least two columns. As shown in FIGS. 3 and 4, the receptacles 102 are oblong in their configuration. Referring again to FIG. 6A, it may be seen that plurality of first apertures 42 of the at least one blister pack retainer 14 of packaging structure 10 are oblong to conform to the plurality of receptacles 102. As shown, the plurality of second apertures 36 may be in the form of opposing C-cuts for the release of the product, while the plurality of first apertures 42 may be fully formed oblong cuts for pressing and dispensing the product through the plurality of second apertures 36. As may be appreciated, first apertures 42 and second apertures 36 may be aligned, one side for accommodating the receptacles 102, the other for product discharge.

In another form depicted in FIG. 6B, a plurality of first apertures 42' and/or the plurality of second apertures 36' of at least one blister pack retainer 14 of packaging structure 10 may also be oblong to conform to the plurality of receptacles 102. As shown, the plurality of second apertures 36' may be in the form of fully formed oblong cuts for the release of the product, while the plurality of first apertures 42' may also be fully formed oblong cuts for pressing and dispensing the product through the plurality of second apertures 36'. As may be appreciated, first apertures 42' and second apertures 36' may be aligned, one side for accommodating the receptacles 102, the other for product discharge.

In one form, packaging structure 10 is configured to allow product discharge without removing blister pack 100.

Figure 5:
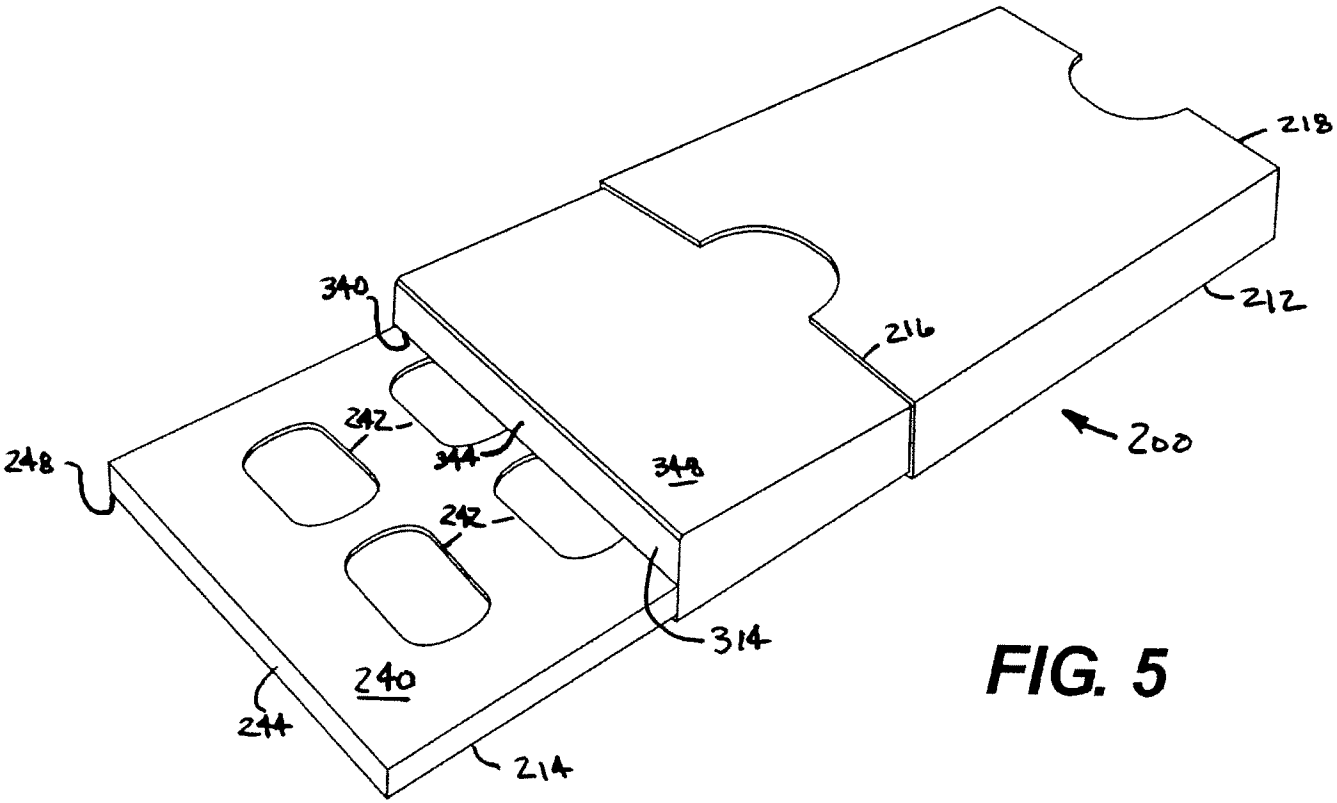
FIG. 5 is a perspective view of a dual blister pack packaging structure showing a pair of partially withdrawn blister pack retainers, in accordance herewith.

Referring now to FIG. 5, in another form, a dual blister pack packaging structure 200 is shown, which includes a first blister pack retainer 214 for receiving a first blister pack (not shown) and a second blister pack retainer 314 for receiving a second blister pack (also not shown).

First blister pack retainer 214 has a first side member 240 and a second side member 248, a first end 244 and a second end (not shown). As with the embodiment of FIGS. 1-4, the second end may be provided with at least one tab portion extending from second end and folded back onto first side member 240. In one form, two tab portions extend from second end and are folded back onto first side member 240.

Likewise, second blister pack retainer 314 has a first side member 340 and a second side member 348, a first end 344 and a second end 346. Again, the second end (not shown) may be provided with at least one tab portion (not shown) extending from second end and folded back onto first side member 340. In one form, two tab portions (not shown) extend from second end and are folded back onto first side member 340.

Referring still to FIG. 5, a slidable cover 212 is provided for enclosing the first and second blister pack retainers 214 and 314. Slidable cover 212 has a first end 216 and a second end 218, first end 216 having at least one tab stop member (not shown) extending therefrom. As with the single blister pack form of FIGS. 1-4, when the first blister pack retainer 214 or the second blister pack retainer 314 is withdrawn from the slidable cover 212, the at least one tab stop member of the slidable cover 212 and the at least one tab portions of the first and second blister pack retainers 214 and 314 cooperate to restrain the first and second blister pack retainers 214 and 314 from being fully withdrawn from the slidable cover 212.

In one form, the first side member 240 of first blister pack retainer 214 is provided with a plurality of first apertures 242. Likewise, the second side member 248 of first blister pack retainer 214 is provided with a plurality of second apertures 236. As with the form depicted in FIG. 6A (or alternatively FIG. 6B), the first apertures 242 are at least partially aligned with the second apertures 236.

As with first blister pack retainer 214, the first side member 340 of second blister pack retainer 314 may be provided with a plurality of first apertures (not shown). Second side member 340 of second blister pack retainer 314 may be provided with a plurality of second apertures (not shown). Again, the first apertures may be at least partially aligned with the second apertures.

As may be appreciated, the packaging structures disclosed herein provide a surface area for the printing of graphics and product information. Referring again to FIGS. 1 and 2, in one form, an outer surface 24 of slidable cover 12 is provided with a printable region for displaying informational material. In another form, an outer surface of blister pack retainer 14 may be provided with a printable region for displaying informational material.

Referring again to FIGS. 6A and 6B, in one form, blister pack retainer 14 of packaging structure 10 may be formed from a substrate 38, which may be cut from a single sheet of stock. A plurality of first apertures 42 or 42' are formed within the first side member 40 and a plurality of second apertures 36 or 36' are formed within the second side member 48. In another form, the first apertures 42 or 42' are formed so as to be at least partially aligned with the second apertures 36 or 36', when first retainer portion 32 is folded and positioned above second retainer portion 34 to form blister pack retainer 14.

Figure 7:
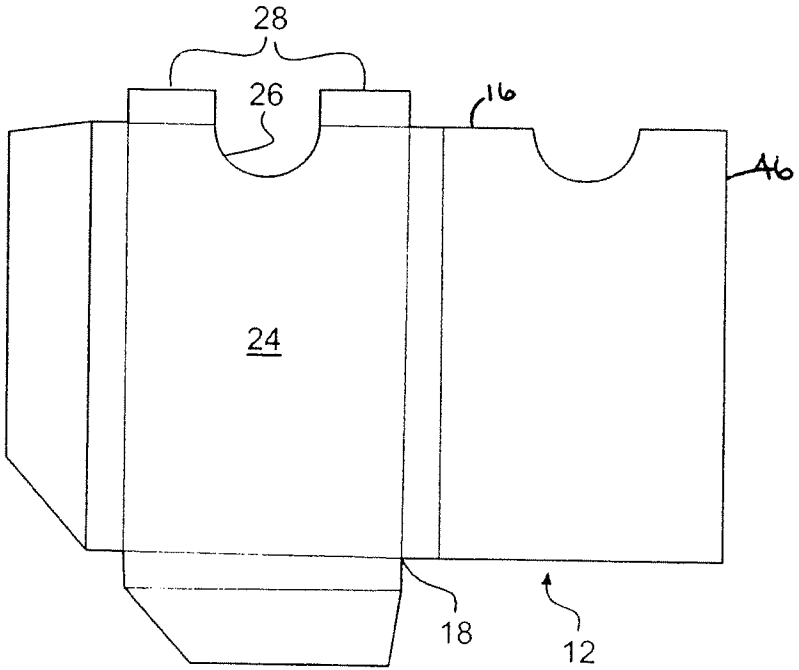
FIG. 7 depicts a lay flat view of a substrate for use in forming a slidable cover of a packaging structure, in accordance herewith.

Referring now to FIG. 7, a substrate 46 may be formed from a single cut sheet of stock and folded to form a slidable cover 12 for enclosing the at least one blister pack retainer. The slidable cover 12 has a first end 16 and a second end 18, first end 16 having at least one tab stop member 28 extending therefrom. When assembled, the at least one tab stop member 28 is folded along a line formed by first end 16 inside slidable cover 12. The at least one tab stop member 28 of the slidable cover 12 and the at least one tab portion 50 of the at least one blister pack retainer 14 (see FIGS. 6A and 6B) cooperate to restrain the at least one blister pack retainer 14 from being fully withdrawn from the slidable cover 12.

In one form, during assembly, blister pack 100 may be placed within blister pack retainer 14 prior to folding. An adhesive may be employed to fix blister pack 100 in place and to bond edge portions of blister pack retainer 14 to form a box-like structure. As may be appreciated, in one form, the plurality of receptacles 102 of blister pack 100 are placed within the plurality of first apertures 42 of blister pack retainer 14 or the plurality of second apertures 36.

Figure 8:
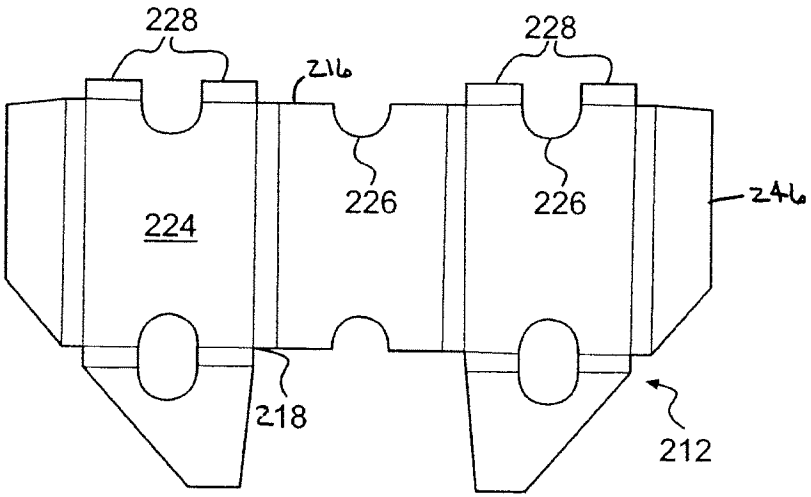
FIG. 8 depicts a lay flat view of a substrate for use in forming a slidable cover of a dual blister pack packaging structure, in accordance herewith.

Referring now to FIG. 8, in another form, a dual blister pack slidable cover 212 may be formed from a substrate 246, which may be cut from a single sheet of stock. When assembled, dual blister pack slidable cover 212 may enclose a first blister pack retainer 214 (see FIG. 5) for receiving a first blister pack (not shown) and a second blister pack retainer 314 (see FIG. 5) for receiving a second blister pack (also not shown).

When assembled, slidable cover 212 has a first end 216 and a second end 218, first end 216 having at least one tab stop member 228 extending therefrom. As with the single blister pack form of FIGS. 1-4, when the first blister pack retainer 214 or the second blister pack retainer 314 is withdrawn from the slidable cover 212, the at least one tab stop member 228 of the slidable cover 212 and the at least one tab portions 250 and 350 of the first and second blister pack retainers 214 and 314 cooperate to restrain the first and second blister pack retainers 214 and 314 from being fully withdrawn from the slidable cover 212.

Substrates 38 and/or 46 and/or 246 may be made from cardboard stock that is relatively thick and stiff, a paper (pulp and fiber) product or other substitute materials, such as synthetic plastics and multi-layer composites, as those skilled in the art will plainly recognize.

In another aspect, provided is a method of forming a packaging structure from a sheet of stock. The method includes the steps of cutting the sheet of stock into a size and shape sufficient to form at least a first and a second substrate having a plurality of panels, folding the first substrate to form a blister pack retainer for receiving a blister pack, the blister pack retainer having a first side member, a second side member, a first end and a second end, said second end having at least one tab portion extending therefrom, and folding the second substrate to form a slidable cover for enclosing the blister pack retainer, the slidable cover having a first end and a second end, said first end having at least one tab stop member extending therefrom, whereby when the blister pack retainer is withdrawn from the slidable cover, the at least one tab stop member of the slidable cover and the at least one tab portion of the blister pack retainer cooperate to restrain the at least one blister pack retainer from being fully withdrawn from the slidable cover.

Referring again to FIG. 3, blister pack 100 may be formed by molding a resiliently deformable synthetic plastic, such as polyvinyl chloride (PVC) or, alternatively, an aluminum laminate, such as a polyamide/aluminum/PVC shell, with a pre-configured array of multiple discrete receptacles 102 or blisters.

As may be appreciated, a tablet (not shown) is captured or restrained within receptacles 102, by a releasable, removable or frangible backing layer (not shown), typically produced from a metal, such as aluminum foil, metalized plastics foil, or a laminated paper and foil combination. In a laminated paper and foil combination, the paper is adhesively bonded in a laminated, multi-ply, overlay to the foil, and used as a lift-off release layer. As such, the paper is intended to protect the underlying foil while the paper is in place. To that end, the paper is bonded to the foil, and is not otherwise secured to the blister pack 100 itself.

In practice, the foil is fused, by heat welding, such as by a heated profiled platen, to the receptacle 102, except for certain localized areas, such as at the edges, which serve as a backing paper lift-off point for paper separation and removal from the foil. The paper overlay effectively obscures the foil and impedes piecemeal foil and receptacle separation.

Generally, the paper layer constitutes a tamper-resistant and child-resistant layer to prevent casual blister pack content discharge, such as through inquisitive handling and experimentation. Once the paper overlay is peeled back from the foil underlay, over a selected tablet receptacle of the blister pack, foil puncture is allowed.

To assist localized peeling of the protective paper backing layer, it is known to apply a matrix or grid of perforations, say, upon pack fabrication and assembly. Thus local removal of a paper backing cover portion overlying a particular receptacle and local exposure of foil overlying that pocket, allows content displacement and ultimate ejection, upon foil tearing or rupture, by depressing the relevant resiliently deformable blister receptacle wall.

As may be appreciated, machines dedicated to blister pack production that are capable of high speed operation are envisioned for use in the production of blister pack 100.

As indicated, packaging structures 10 and 200 may advantageously be employed to package a plurality of dissolvable compressed tobacco products that are adapted to be consumed orally. Compressed tobacco products of this type are disclosed in Provisional Application Ser. No. 60/990,661, the contents of which are hereby incorporated for all that they disclose. Such compressed tobacco products are formed from a composition that includes at least one tobacco component, at least one flavorant, at least one sweetener, at least one filler-binder, at least one lubricant; at least one desiccant and a glidant. The outer surfaces of the compressed tobacco products packaged within packaging structures 10 and 200 may optionally be coated, treated, embossed or debossed and, in the case of a blister pack 100 having transparent receptacles 102, such surface characteristics may be readily apparent to the consumer.

Advantageously, packaging structures 10 and 200 are designed to be capable of high speed assembly, and employ the attendant machines and processes associated therewith.

As may be appreciated, the packaging structures disclosed herein can provide the following features: tamper prevention, larger surface area for graphics, means for supplying a blister strip in a single unit, small enough to fit in a person's pocket, easy closure to provide a clean look and feel even after opening, premium finished appearance that hides the blister for a non-pharmaceutical look, and multiple compartments to contain product and facilitate access to the product.

The design of the packaging structures disclosed herein allows for multiple quantities to be packaged. The forms contemplated include 8, 10, 16, and 20 count packages. Additionally, many variations of inner blister pack retainer quantities and positions can be used. Furthermore, in the double inner blister pack retainer versions, it is possible to permit the blister pack retainer to be accessed from either end of the sleeve.

All patents, test procedures, and other documents cited herein, including priority documents, are fully incorporated by reference to the extent such disclosure is not inconsistent with this disclosure and for all jurisdictions in which such incorporation is permitted.

While the illustrative embodiments disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside herein, including all features which would be treated as equivalents thereof by those skilled in the art to which the disclosure pertains.

What is claimed is:

1. A packaging structure for receiving at least one blister pack, comprising:

a) at least one blister pack retainer for receiving and enclosing a blister pack, said blister pack retainer having a first side member having a plurality of first apertures, a second side member having a plurality of second apertures, a first end and a second end, said at least one blister pack retainer structurally forming a cuboid, said second end having a plurality of tab portions extending outwardly from a surface of at least one of said first or second side members, and a plurality of receptacles positioned within either the plurality of first or second apertures; and b) a slidable cuboidal cover for enclosing said at least one blister pack retainer, said cover having a first end and a second end, said first end having a plurality of tab stop members extending inwardly therefrom, whereby when said at least one blister pack retainer is withdrawn from said slidable cover, said plurality of inwardly extending tab stop members of said slidable cover and said plurality of outwardly extending tab portions of said at least one blister pack retainer cooperate to restrain said at least one blister pack retainer from being fully withdrawn from said slidable cover.

2. The packaging structure of claim 1, said first apertures being at least partially aligned with the second apertures.

3. The packaging structure of claim 2, wherein each of said plurality of receptacles contains a tablet.

4. The packaging structure of claim 1, wherein the plurality of receptacles are arranged in at least two columns.

5. The packaging structure of claim 1, wherein the first and/or second apertures are oblong.

6. The packaging structure of claim 1, wherein said second end of said at least one blister pack retainer includes a pair of tab portions extending outwardly from the surface of said first or second side member.

7. The packaging structure of claim 6, wherein said first end of said slidable cover includes a pair of tab stop members extending inwardly therefrom.

8. The packaging structure of claim 1, further comprising a second blister pack retainer according to claim 1.

9. The packaging structure of claim 1, wherein the packaging structure is formed from a sheet of cardboard stock.

10. A packaging structure for receiving at least one blister pack, comprising:

a) at least one cuboidal blister pack retainer for receiving and enclosing the blister pack, said blister pack retainer having a first side member, a second side member, a first end and a second end, said second end having a plurality of tab portions extending outwardly from a surface of either said first or second side member and disposed at lateral portions thereof; and b) a slidable cuboidal cover for enclosing said at least one blister pack retainer, said cover having a first end and a second end, said first end having a plurality of tab stop members extending inwardly and disposed at lateral portions thereof and in substantial linear alignment with said plurality of tab portions on said blister pack retainer, whereby when said at least one blister pack retainer is withdrawn from said slidable cover, said plurality of tab stop members of said slidable cover and said plurality of tab portions of said at least one blister pack retainer cooperate to restrain said at least one blister pack retainer from being fully withdrawn from said slidable cover.

* * * * *